US006302727B1

(12) United States Patent
Fedorjaka

(10) Patent No.: US 6,302,727 B1
(45) Date of Patent: Oct. 16, 2001

(54) MULTI-AXIS CONNECTORS AND ELECTRONIC DEVICES INCORPORATING SAME

(75) Inventor: John Fedorjaka, Apex, NC (US)

(73) Assignee: Telefonaktiebolaget, L.M. Ericsson, Stockholm (SE)

( * ) Notice: Subject to any disclaimer, the term of this patent is extended or adjusted under 35 U.S.C. 154(b) by 0 days.

(21) Appl. No.: 09/658,127

(22) Filed: Sep. 8, 2000

(51) Int. Cl.[7] ..... H01R 3/00
(52) U.S. Cl. ..... 439/500; 439/862
(58) Field of Search ..... 439/68, 862, 500, 439/628; 429/96, 100

(56) References Cited

U.S. PATENT DOCUMENTS 3,270,311 * 8/1966 Deer et al. .
5,473,242 * 12/1995 McKenna ..... 320/2
5,634,801 6/1997 Johnson ..... 439/71
5,885,090 * 3/1999 Comstock et al. ..... 439/65
5,909,102 * 6/1999 Stone, III et al. ..... 320/144
5,971,784 10/1999 Fabian et al. ..... 439/224
6,077,130 * 6/2000 Hughes et al. ..... 439/862

* cited by examiner

*Primary Examiner*—Tulsidas Patel
*Assistant Examiner*—Hae Moon Hyeon
(74) *Attorney, Agent, or Firm*—Myers Bigel Sibley & Sajovec

(57) ABSTRACT

Multi-axis electrical connectors for use within electronic devices such as radiotelephones are provided that may reduce the risk of electrical circuit breaks caused by impacts and/or vibrations. Multi-axis electrical connectors are configured to electrically communicate with electronic modules via multi-axis electrical interfaces. Electrical contact between a first set of contacts and an electrical interface along a direction can be maintained when a force is applied along a transverse direction. Conversely, electrical contact between a second set of contacts and another portion of the electrical interface along another direction can be maintained when a force is applied along a transverse direction.

31 Claims, 4 Drawing Sheets

MULTI-AXIS CONNECTORS AND ELECTRONIC DEVICES INCORPORATING SAME

FIELD OF THE INVENTION

The present invention relates generally to electronic devices, and more particularly to electrical connectors for use in electronic devices.

BACKGROUND OF THE INVENTION

An electronic device, such as a radiotelephone, may include one or more removable modules. For example, a radiotelephone may include a removable battery module that supplies electrical power to the radiotelephone. Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Electrical connectors with in-line, spring-actuated contacts are often used as an interface between radiotelephones and removable battery modules because the spring-actuated contacts may allow for easy engagement and disengagement of the battery modules. However, because radiotelephones may be subjected to impact shocks (e.g., a radiotelephone may be dropped) and vibrations during operation, conventional electrical connectors having in-line, spring-actuated contacts may experience momentary breaks in electrical continuity if a force is in a direction transverse to a direction of the in-line contacts. A break in electrical continuity between a radiotelephone and a battery module may result in a loss of power to the radiotelephone which, in turn, may result in dropped calls and/or lost data.

Plug and socket-types of connectors may provide a reliable electrical interface between a radiotelephone and a battery module, even in the presence of impacts and vibrations. Unfortunately, these types of electrical connectors are generally considered less desirable for use in connecting a battery module with a radiotelephone because they may be difficult to engage and disengage.

SUMMARY OF THE INVENTION

In view of the above discussion, electrical connectors for use within electronic devices such as radiotelephones are provided that may reduce the risk of electrical circuit breaks caused by impacts and/or vibrations. In particular, a multi-axis electrical connector is configured to electrically communicate with an electronic module via a corresponding multi-axis electrical interface.

According to an embodiment of the present invention, a multi-axis electrical connector includes a housing having opposite end portions. One end portion of the housing includes first and second walls that are oriented transversely to each other in a substantially perpendicular, intersecting configuration. A plurality of first apertures are formed within the first wall in adjacent, spaced-apart relationship, and a plurality of second apertures are formed in the second wall in adjacent, spaced-apart relationship. The opposite end portion of the housing includes a third wall having a plurality of third apertures formed therein in adjacent, spaced-apart relationship.

A plurality of first and second conductive members are disposed within the housing in respective sets of pairs. End portions of these conductive members extend outwardly from the respective apertures along respective directions. A portion of one end of each of the first conductive members extends outwardly from a respective one of the first apertures and serves as a first electrical contact. A portion of the opposite end of each of the first conductive members extends outwardly from a respective one of the third apertures and serves as a second electrical contact. According to an embodiment of the present invention, the first and second electrical contacts may have an arcuate configuration.

Each of the first electrical contacts is configured to be elastically deflected towards the first wall when a force is applied thereto by an electrical contact of an electronic module. Similarly, each of the second electrical contacts is configured to be elastically deflected towards the third wall when a force is applied thereto by an electrical contact of an electronic module, substrate, printed circuit board (PCB), or other component.

A portion of one end of each of the second conductive members extends outwardly from a respective one of the second apertures and serves as a third electrical contact. A portion of the opposite end of each of the second conductive members extends outwardly from a respective one of the third apertures and serves as a fourth electrical contact.

Each of the third electrical contacts is configured to be elastically deflected towards the second wall when a force is applied thereto by an electrical contact of an electronic module. Similarly, each of the fourth electrical contacts is configured to be elastically deflected towards the third wall when a force is applied thereto by an electrical contact of an electronic module, substrate, printed circuit board (PCB), or other component.

The first and third electrical contacts extend outwardly along substantially transverse (e.g., "X" and "Y") directions. As such, electrical contact may be maintained between the first electrical contacts and an electrical interface of an electronic module when electrical contact is lost between the third electrical contacts and the electrical interface. Conversely, electrical contact may be maintained between the third electrical contacts and an electrical interface of an electronic module when electrical contact is lost between the first electrical contacts and the electrical interface.

According to another embodiment of the present invention, each conductive member includes an intermediate portion that is configured to restrain movement within the housing when various forces are applied to the conductive member ends.

According to another embodiment of the present invention, an electrical connector includes a housing having opposite first and second end portions. First and second electrically conductive members are disposed within the housing. The first electrically conductive member has opposite first and second ends, and a portion of the first end extends from the housing first end portion. The first end can be elastically deflected along a first direction when a force is applied to the first end. The second end extends from the housing second end portion.

The second electrically conductive member has opposite third and fourth ends, and a portion of the third end extends from the housing first end portion. The third end can be elastically deflected along a second direction transverse to the first direction when a force is applied to the third end. The fourth end extends from the housing second end portion. The first and second directions may be substantially perpendicular to each other, such as "X" and "Y" directions in a Cartesian coordinate system.

The first electrically conductive member second end and the second electrically conductive member fourth end are in adjacent spaced-apart relationship. Preferably, the second end of the first electrically conductive member can be elastically deflected along a third direction when a force is applied to the second end, and the fourth end of the second electrically conductive member can be elastically deflected along the third direction when a force is applied to the fourth end. The third direction may be transverse to the first and/or second directions.

Electrical connectors according to the present invention may be particularly well suited for use within a variety of electronic devices including radiotelephones that may be subjected to impacts and vibrations during operation. Arranging electrical contacts transversely to each other in a substantially perpendicular configuration may reduce, and preferably eliminate, the possibility of breaks in electrical continuity caused by vibrations or shock. In addition, electrical connectors according to the present invention can be small in size which may save internal radiotelephone space and which may lead to manufacturing cost savings.

DETAILED DESCRIPTION OF THE INVENTION

Figure 1:
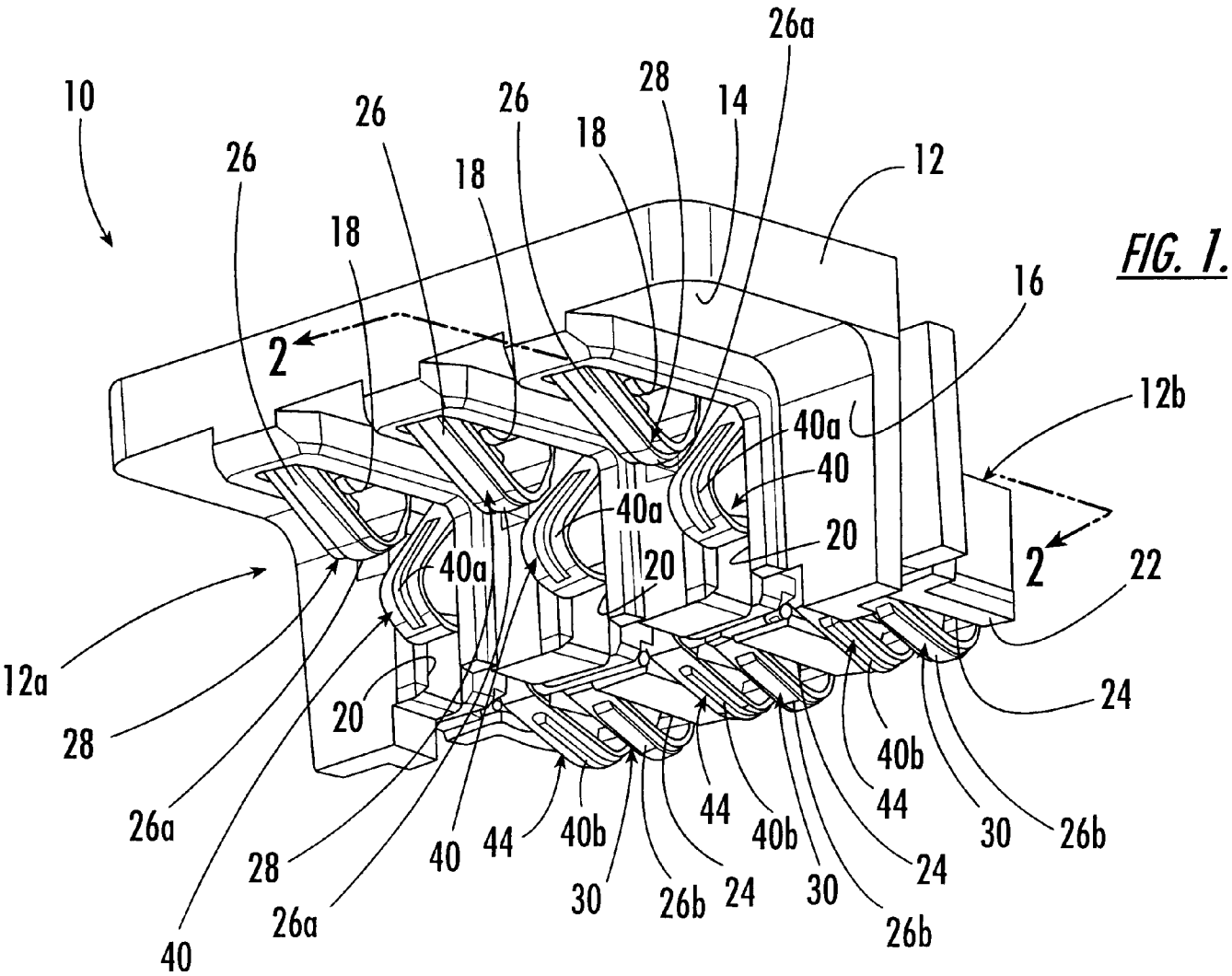
FIG. 1 is an enlarged perspective view of an electrical connector according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of lines, layers and regions may be exaggerated for clarity.

Figure 2:
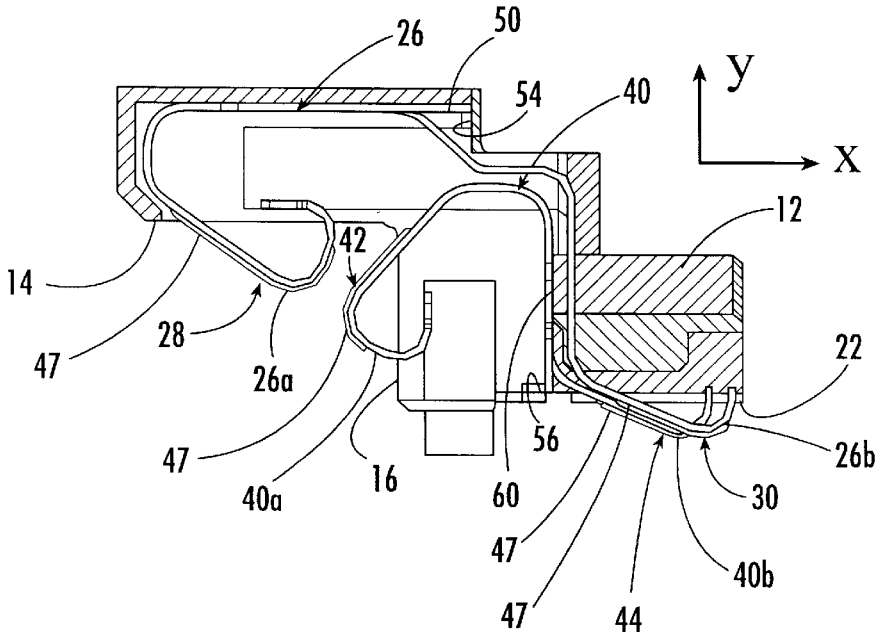
FIG. 2 is a section view of the electrical connector of FIG. 1 taken along lines 2—2 illustrating the position of a pair of first and second conductive members within the electrical connector housing.

Referring initially to FIGS. 1–2, a multi-axis electrical connector 10 according to an embodiment of the present invention is illustrated. The illustrated electrical connector 10 includes a housing 12 having opposite first and second end portions 12*a*, 12*b*. The housing first end portion 12*a* includes first and second walls 14, 16 that are oriented transversely to each other in a substantially perpendicular, intersecting configuration. A plurality of first apertures 18 are formed within the first wall 14 in adjacent, spaced-apart relationship, and a plurality of second apertures 20 are formed in the second wall 16 in adjacent, spaced-apart relationship, as illustrated.

The housing second end portion 12*b* also includes a third wall 22 having a plurality of third apertures 24 formed therein in adjacent, spaced-apart relationship, as illustrated. The second and third walls 16, 22 are oriented transversely to each other in a substantially perpendicular, intersecting configuration, as illustrated. As such, the first and third walls 14, 22 are generally parallel with each other. However, it is understood that the first, second, and third walls 14, 16, 22 need not be oriented as illustrated. For example, the first and second walls 14, 16 need not be perpendicular and the second and third walls 16, 22 need not be perpendicular.

Still referring to FIG. 1, a plurality of first electrically conductive members 26 and a plurality of second electrically conductive members 40 are disposed within the housing 12 in pairs, as illustrated. As will be described below, end portions of these first and second conductive members 26, 40 extend outwardly from the respective apertures 18, 20, 24 along respective directions or axes.

Figure 3A:
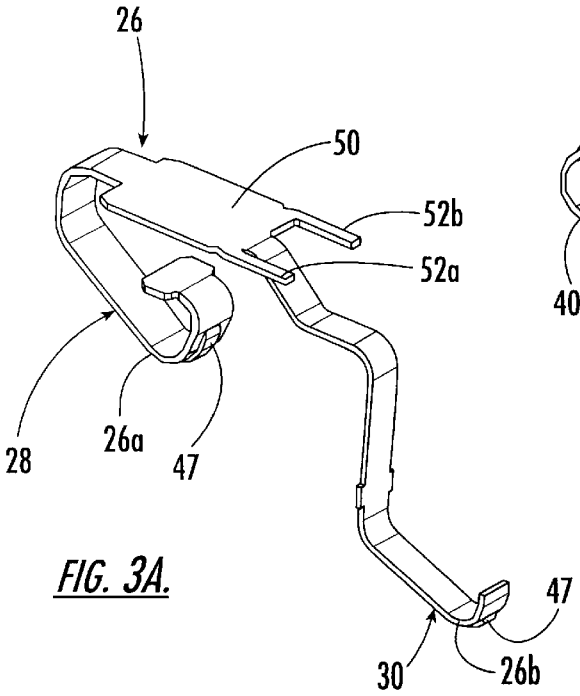
FIG. 3A is a perspective view of the first conductive member of the electrical connector of FIG. 1.
Figure 3B:
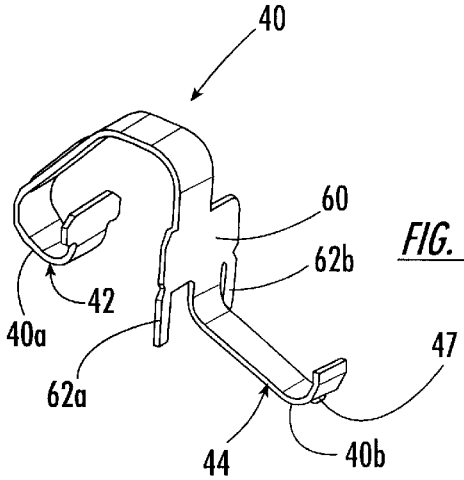
FIG. 3B is a perspective view of the second conductive member of the electrical connector of FIG. 1.
Figure 4:
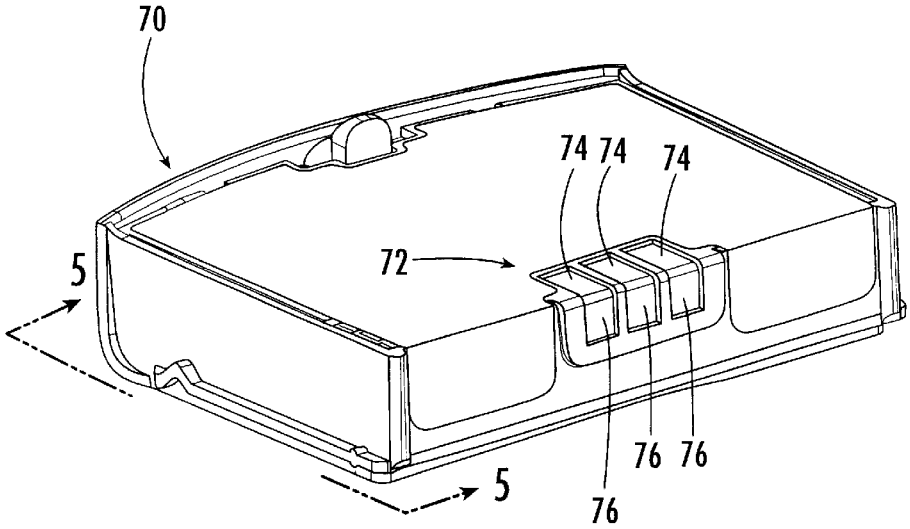
FIG. 4 is a perspective view of an exemplary electronic module configured to be removably secured to an electronic device and electrically connected thereto via the electrical connector of FIG. 1

Referring now to FIGS. 2–4, the first and second electrically conductive members 26, 40 will be described in detail. Each first conductive member 26 includes opposite first and second ends 26*a*, 26*b*. In the illustrated embodiment, first and second ends 26*a*, 26*b* have an arcuate configuration. However, it is understood that the first and second ends 26*a*, 26*b* of the first conductive member 26 are not limited to the illustrated arcuate configurations. Various configurations, arcuate and/or non-arcuate, may be utilized without limitation.

As illustrated in FIGS. 1 and 2, a portion of first end 26*a* of each of the first conductive members 26 extends outwardly from a respective one of the first apertures 18 and serves as a first electrical contact 28. A portion of second end 26*b* of each of the first conductive members 26 extends outwardly from a respective one of the third apertures 24 and serves as a second electrical contact 30. Electrical contacts 28 and 30 are configured to establish electrical communications between a contact interface of an electronic module having substantially perpendicular or "multi-axis" contacts or patches, as will be described in detail below.

Each of the illustrated first conductive members 26 has a generally slender configuration. Furthermore, first end 26*a* of each of the first conductive members 26 (which serves as a first electrical contact 28) is configured to be elastically deflected towards the first wall 14 when a force is applied thereto by an electrical contact of an electronic module. (See FIG. 7). Similarly, second end 26*b* of each of the first conductive members 26 (which serves as a second electrical contact 30) is configured to be elastically deflected towards the third wall 22 when a force is applied thereto by an electrical contact of an electronic module, substrate, printed circuit board (PCB), or other component.

Each of the second conductive members 40 includes opposite third and fourth ends 40*a*, 40*b*. In the illustrated embodiment, the third and fourth ends 40*a*, 40*b* of each of the second conductive members 40 have an arcuate configuration. It is understood, however, that the third and fourth ends 40*a*, 40*b* of a second electrically conductive member 40 according to the present invention are not limited to the illustrated arcuate configurations. Various configurations may be utilized without limitation.

As illustrated in FIGS. 1 and 2, a portion of third end 40*a* of each of the second conductive members 40 extends outwardly from a respective one of the second apertures 20 and serves as a third electrical contact 42. A portion of fourth end 40*b* of each of the second conductive members 40 extends outwardly from a respective one of the third apertures 24 and serves as a fourth electrical contact 44. Fourth end 40*b* of a second electrically conductive member 40 and second end 26*b* of a first electrically conductive member 26 both extend outwardly from a respective one of the third apertures 24 in adjacent, spaced-apart relationship, as illustrated in FIG. 1.

In the illustrated embodiment, a conductive material 47 is disposed on the first and second ends 26*a*, 26*b* of the first conductive members 26 and on the third and fourth ends 40*a*, 40*b* of the second conductive members 40. As would be understood by those of skill in the art, this conductive material can enhance electrical contact between the respective first, second, third, and fourth ends 26*a*, 26*b*, 40*a*, 40*b* and electrical contacts and/or circuitry that come in contact therewith.

Each of the illustrated second conductive members 40 has a generally slender configuration. Furthermore, third end 40*a* of each of the second conductive members 40 (which serves as a third electrical contact 42) is configured to be elastically deflected towards the second wall 16 when a force is applied thereto by an electrical contact of an electronic module. (See FIG. 7). Similarly, fourth end 40*b* of each of the second conductive members 40 (which serves as a fourth electrical contact 44) is configured to be elastically deflected towards the third wall 22 when a force is applied thereto by an electrical contact of an electronic module, substrate, printed circuit board (PCB), or other component.

As illustrated in FIGS. 3A–3B, each first conductive member 26 includes an intermediate portion 50 between the opposite arcuate first and second ends 26*a*, 26*b*, that is configured to restrain movement of the first conductive member 26 within the housing 12 when forces are applied to the first and second ends 26*a*, 26*b*. Similarly, each second conductive member 40 includes an intermediate portion 60 between the opposite arcuate third and fourth ends 40*a*, 40*b*, that is configured to restrain movement of the second conductive member 40 within the housing 12 when forces are applied to third and fourth ends 40*a*, 40*b*.

The illustrated first conductive member intermediate portion 50 includes a pair of prongs 52*a*, 52*b*that are configured to engage an internal wall 54 within the housing 12 (FIG. 2) so as to limit movement of the first conductive member 26 along the "X" direction. Similarly, the illustrated second conductive member intermediate portion 60 includes a pair of prongs 62*a*, 62*b*that are configured to engage an internal wall 56 within the housing 12 (FIG. 2) so as to limit movement of the second conductive member 40 along the "Y" direction. It is understood that lateral movement (i.e., movement along the "Z" direction) of the first and second conductive members 26, 40 is restrained by the housing 12. Accordingly, when an electronic module is inserted within an electronic device incorporating an electrical connector 10 according to the present invention, the conductive members 26, 40 can be limited, and preferably restrained, in movement within the housing.

Referring now to FIG. 4, an electronic module 70, such as a battery module, configured to be removably secured to an electronic device and electrically connected thereto via an electrical connector 10 according to the present invention, is illustrated. The illustrated electronic module 70 includes a contact interface 72 having a plurality of first and second contacts or patches 74, 76. The first and second contacts 74, 76 are oriented transversely to each other in a substantially perpendicular, intersecting configuration for engagement with the plurality of first and third electrical contacts 28, 42 of the electrical connector 10.

Figure 5:
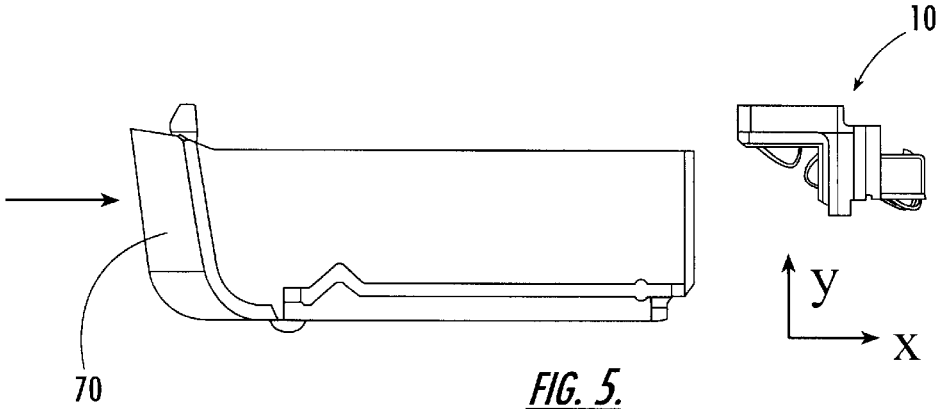
FIG. 5 is a side elevation view of the electronic module of FIG. 4 taken along lines 5—5 being moved along the "X" direction and towards engagement with the electrical connector of FIG. 1.
Figure 6:
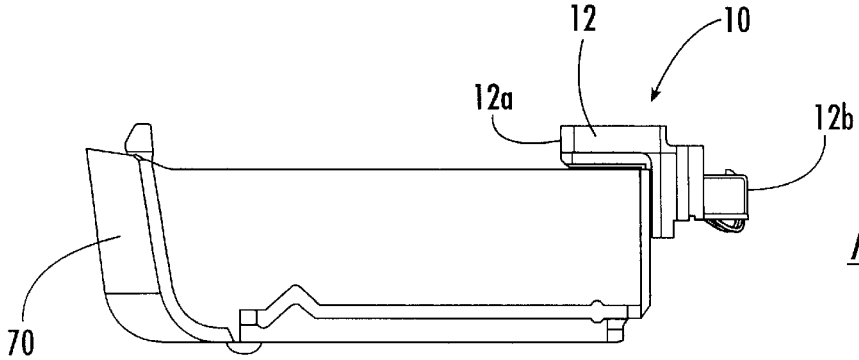
FIG. 6 is a side elevation view of the electronic module of FIG. 4 taken along lines 5—5 engaged with the electrical connector of FIG. 1.

Referring to FIG. 5, the electronic module 70 of FIG. 4 is moving along the "X" direction towards engagement with the electrical connector 10. In FIG. 6, the electronic module 70 is engaged with the electrical connector 10.

Figure 7:
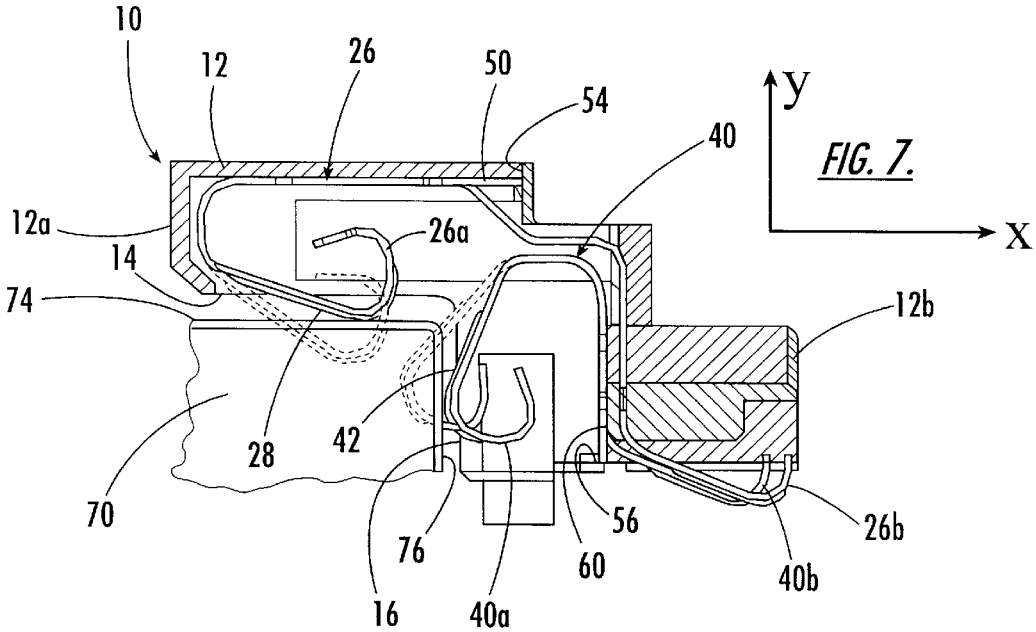
FIG. 7 is an enlarged section view of the electronic module and electrical connector of FIG. 6 illustrating elastic deflection of the respective ends of the first and second conductive members caused by contact with the electronic module, with the undeflected positions of the conductive members illustrated in phantom line.

Referring now to FIG. 7, engagement of an electronic module 70 with an electrical connector 10 according to the present invention is illustrated in greater detail. When the electronic module 70 is engaged with the electrical connector 10, an electrical interface first contact 74 applies a force to the first end 26*a* of a respective first conductive member 26 and elastically deflects the first end 26*a* from an initial undeflected state (represented in phantom line) in a direction towards the first wall 14. Similarly, when the electronic module 70 is engaged with the electrical connector 10, an electrical interface second contact 76 applies a force to the third end 40*a* of a respective second conductive member 40 and elastically deflects the third end 40*a* in a direction towards the second wall 16. The first conductive member first end 26*a* and the second conductive member third end 40*a* deflect elastically and thus act as spring connectors to maintain contact with the respective electrical interface first and second contacts 74, 76, as would be understood by those of skill in the art.

By arranging electrical contacts 28, 42 transversely with respect to each other, the possibility of breaks in an electrical circuit (i.e., electrical continuity) between the electrical connector 10 and the electronic module 70 may be reduced, and preferably eliminated. For example, when an impact force is applied to an electronic device incorporating an electrical connector 10 according to the present invention along the "X" direction, the electrical contact 26 of the first conductive member preferably maintains electrical contact with respective interface contact 74. Similarly, when an impact force is applied to an electronic device incorporating an electrical connector 10 according to the present invention along the "Y" direction, the electrical contact 42 of the second conductive member preferably maintains electrical contact with respective interface contact 76.

Figure 8A:
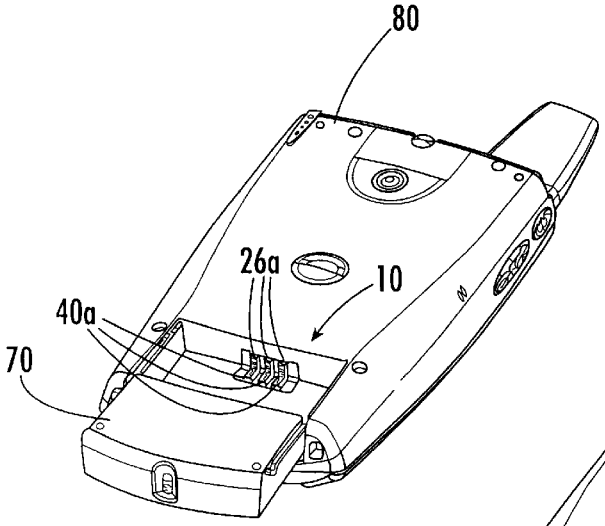
FIGS. 8A–8B are perspective views of an electronic device that utilizes the electrical connector of FIG. 1 for electrically connecting an electronic module. The electronic module is illustrated in an uninstalled condition in FIG. 8A and in an installed condition in FIG. 8B.
Figure 8B:
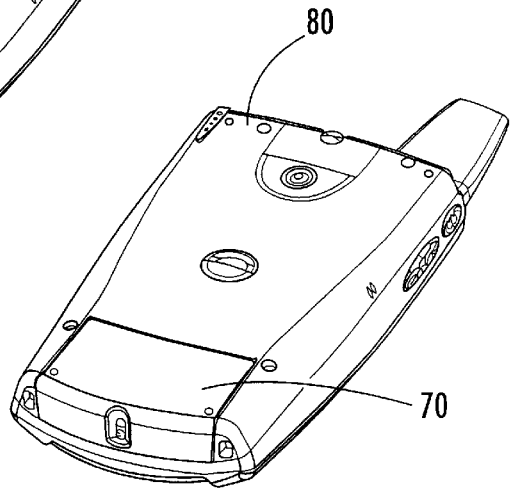

Referring now to FIGS. 8A–8B, an exemplary use for the electrical connector 10 of the present invention is illustrated. The illustrated electrical connector 10 is used to electrically connect a removable electronic module 70 such as a battery module, with an electronic device 80, such as a wireless communications device. The electronic module 70 is illustrated in an uninstalled condition (FIG. 8A) and an installed condition (FIG. 8B). Respective first and third ends 26*a*, 40*a* of the first and second conductive members 26, 40 are exposed in FIG. 8A to receive the respective first and second contacts of an electrical interface (not shown) in the removable module 70 as described above. Opposite second and fourth ends 26*b*, 40*b* (not shown) of the respective first and second conductive members 26, 40 are in electrical communication with electronic circuitry and/or components within the electronic device 80, as would be understood by one of skill in the art.

It is understood that electrical connectors according to the present invention may be utilized within various types of electronic devices and are not limited to wireless communications devices, such as radiotelephones.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An electrical connector, comprising:

a housing having opposite first and second end portions, wherein the housing first end portion includes first and second walls oriented transversely to each other, and wherein first and second apertures are formed within the first and second walls, respectively;

a first electrically conductive member disposed within the housing, wherein the first electrically conductive member comprises opposite first and second ends, wherein a portion of the first end extends from the first aperture and can be elastically deflected towards the first wall when a force is applied to the first end, and wherein the second end extends from the housing second end portion; and a second electrically conductive member disposed within the housing, wherein the second electrically conductive member comprises opposite third and fourth ends, wherein a portion of the third end extends from the second aperture and can be elastically deflected towards the second wall when a force is applied to the third end, and wherein the fourth end extends from the housing second end portion.

2. The electrical connector according to claim 1, wherein the housing second end portion includes a third wall having a third aperture formed therein, wherein a portion of the first electrically conductive member second end extends from the third aperture and can be elastically deflected towards the third wall when a force is applied to the second end, and wherein a portion of the second electrically conductive member fourth end extends from the third aperture and can be elastically deflected towards the third wall when a force is applied to the fourth end.

3. The electrical connector according to claim 2, wherein the first electrically conductive member second end and the second electrically conductive member fourth end are in adjacent spaced-apart relationship.

4. The electrical connector according to claim 2, wherein the second and third walls are oriented transversely to each other.

5. The electrical connector according to claim 2, wherein the first and second walls are perpendicular to each other and wherein the first and third walls are parallel with each other.

6. The electrical connector according to claim 1, wherein the first electrically conductive member first end has an arcuate configuration, and wherein the second electrically conductive member third end has an arcuate configuration.

7. An electrical connector, comprising:

a housing having opposite first and second end portions, wherein the housing first end portion includes first and second walls that are oriented transversely to each other, wherein first and second apertures are formed within the first and second walls, respectively, wherein the housing second end portion includes a third wall having a third aperture formed therein, and wherein the second and third walls are oriented transversely to each other;

a first electrically conductive member disposed within the housing, wherein the first electrically conductive member comprises opposite first and second ends, wherein a portion of the first end extends from the first aperture as a first electrical contact, wherein a portion of the second end extends from the third aperture as a second electrical contact, wherein the first electrical contact can be elastically deflected towards the first wall when a force is applied to the first electrical contact, and wherein the second electrical contact can be elastically deflected towards the third wall when a force is applied to the second electrical contact; and a second electrically conductive member disposed within the housing, wherein the second electrically conductive member comprises opposite third and fourth ends, wherein a portion of the third end extends from the second aperture as a third electrical contact, wherein a portion of the fourth end extends from the third aperture as a fourth electrical contact, wherein the fourth and second electrical contacts are in adjacent spaced-apart relationship, wherein the third electrical contact can be elastically deflected towards the second wall when a force is applied to the third electrical contact, and wherein the fourth electrical contact can be elastically deflected towards the third wall when a force is applied to the fourth electrical contact.

8. The electrical connector according to claim 7, wherein the first and second walls are perpendicular to each other and wherein the first and third walls are parallel with each other.

9. The electrical connector according to claim 7, wherein the first conductive member further comprises a first intermediate portion between the opposite first and second ends and wherein the first intermediate portion is configured to restrain movement of the first conductive member within the housing when a force is applied to at least one of the first and second electrical contacts.

10. The electrical connector according to claim 7, wherein the second conductive member comprises a second intermediate portion between the opposite third and fourth ends and wherein the second intermediate portion is configured to restrain movement of the second conductive member within the housing when a force is applied to at least one of the third and fourth electrical contacts.

11. The electrical connector according to claim 7, wherein the first electrically conductive member first end has an arcuate configuration, and wherein the second electrically conductive member third end has an arcuate configuration.

12. The electrical connector according to claim 7, wherein the first electrically conductive member second end has an arcuate configuration, and wherein the second electrically conductive member fourth end has an arcuate configuration.

13. An electrical connector, comprising:

a housing having opposite first and second end portions, wherein the housing first end portion includes first and second walls that are oriented transversely to each other, wherein first and second apertures are formed within the first and second walls, respectively, and wherein the housing second end portion includes a third wall having a third aperture formed therein;

a first electrically conductive member disposed within the housing, wherein the first electrically conductive member comprises opposite first and second arcuate ends, wherein a portion of the first arcuate end extends from the first aperture as a first electrical contact, wherein a portion of the second arcuate end extends from the third aperture as a second electrical contact, wherein the first electrical contact can be elastically deflected towards the first wall when a force is applied to the first electrical contact, wherein the second electrical contact can be elastically deflected towards the third wall when a force is applied to the second electrical contact, wherein the first conductive member further comprises a first intermediate portion between the opposite first and second arcuate ends, and wherein the first intermediate portion is configured to restrain movement of the first conductive member within the housing when a force is applied to at least one of the first and second electrical contacts; and a second electrically conductive member disposed within the housing, wherein the second electrically conductive member comprises opposite third and fourth arcuate ends, wherein a portion of the third arcuate end extends from the second aperture as a third electrical contact, wherein a portion of the fourth arcuate end extends from the third aperture as a fourth electrical contact, wherein the fourth and second electrical contacts are in adjacent spaced-apart relationship, wherein the third electrical contact can be elastically deflected towards the second wall when a force is applied to the third electrical contact, wherein the fourth electrical contact can be elastically deflected towards the third wall when a force is applied to the fourth electrical contact, wherein the second conductive member comprises a second intermediate portion between the opposite third and fourth arcuate ends, and wherein the second intermediate portion is configured to restrain movement of the second conductive member within the housing when a force is applied to at least one of the third and fourth electrical contacts.

14. The electrical connector according to claim 13, wherein the second and third walls are oriented transversely to each other.

15. The electrical connector according to claim 13, wherein the first and second walls are perpendicular to each other and wherein the first and third walls are parallel with each other.

16. An electrical connector, comprising:

a housing having opposite first and second end portions, wherein the housing first end portion includes first and second walls that are oriented transversely to each other, wherein a plurality of first apertures are formed within the first wall in adjacent, spaced-apart relationship, wherein a plurality of second apertures are formed within the second wall in adjacent, spaced-apart relationship, and wherein the housing second end portion includes a third wall having a plurality of third apertures formed therein in adjacent, spaced-apart relationship; and a plurality of pairs of conductive members disposed within the housing, wherein each pair of conductive members comprises:

a first electrically conductive member, wherein the first electrically conductive member comprises opposite first and second arcuate ends, wherein a portion of the first arcuate end extends from a respective one of the first apertures as a first electrical contact, wherein a portion of the second arcuate end extends from a respective one of the third apertures as a second electrical contact, wherein the first electrical contact can be elastically deflected towards the first wall when a force is applied to the first electrical contact, and wherein the second electrical contact can be elastically deflected towards the third wall when a force is applied to the second electrical contact; and a second electrically conductive member disposed within the housing, wherein the second electrically conductive member comprises opposite third and fourth arcuate ends, wherein a portion of the third arcuate end extends from a respective one of the second apertures as a third electrical contact, wherein a portion of the fourth arcuate end extends from the respective third aperture as a fourth electrical contact, wherein the fourth and second electrical contacts are in adjacent, spaced-apart relationship, wherein the third electrical contact can be elastically deflected towards the second wall when a force is applied to the third electrical contact, and wherein the fourth electrical contact can be elastically deflected towards the third wall when a force is applied to the fourth electrical contact.

17. The electrical connector according to claim 16, wherein the second and third walls are oriented transversely to each other.

18. The electrical connector according to claim 16, wherein the first and second walls are perpendicular to each other and wherein the first and third walls are parallel with each other.

19. The electrical connector according to claim 16, wherein the first conductive member further comprises a first intermediate portion between the opposite first and second ends and wherein the first intermediate portion is configured to restrain movement of the first conductive member within the housing when a force is applied to at least one of the first and second electrical contacts.

20. The electrical connector according to claim 16, wherein the second conductive member comprises a second intermediate portion between the opposite third and fourth ends and wherein the second intermediate portion is configured to restrain movement of the second conductive member within the housing when a force is applied to at least one of the third and fourth electrical contacts.

21. An electronic device, comprising:

a housing;

electronic circuitry disposed within the housing;

an electronic module configured to be removably secured to the housing, wherein the electronic module comprises a contact interface having first and second contact portions oriented transversely to each other; and an electrical connector that electrically connects the electronic module contact interface with the electronic circuitry within the housing, wherein the electrical connector comprises:

a connector housing having opposite first and second end portions, wherein the connector housing first end portion includes first and second walls oriented transversely to each other, and wherein first and second apertures are formed within the first and second walls, respectively;

a first electrically conductive member disposed within the connector housing, wherein the first electrically conductive member comprises opposite first and second ends, wherein a portion of the first end extends from the first aperture as a first electrical contact, wherein the second end extends from the connector housing second end portion as a second electrical contact, wherein the first electrical contact is in electrical communication with the first contact portion of the electronic module contact interface, and wherein the second electrical contact is in electrical communication with the electronic circuitry within the housing; and a second electrically conductive member disposed within the connector housing, wherein the second electrically conductive member comprises opposite third and fourth ends, wherein a portion of the third end extends from the second aperture as a third electrical contact, wherein the fourth end extends from the connector housing second end portion as a fourth electrical contact, wherein the third electrical contact is in electrical communication with the second contact portion of the electronic module contact interface, and wherein the fourth electrical contact is in electrical communication with the electronic circuitry within the housing.

22. The electronic device according to claim 21, wherein the second and fourth electrical contacts are in adjacent spaced-apart relationship.

23. The electronic device according to claim 21, wherein the second and third walls of the electrical connector housing are oriented transversely to each other.

24. The electronic device according to claim 21, wherein the first and second walls of the electrical connector housing are perpendicular to each other and wherein the first and third walls of the electrical connector housing are parallel with each other.

25. The electronic device according to claim 21, wherein the first electrical contact is elastically deflected towards the first wall by a force applied to the first electrical contact by the first contact portion of the electronic module, and wherein the third electrical contact is elastically deflected towards the second wall by a force applied to the third electrical contact by the second contact portion of the electronic module.

26. The electronic device according to claim 21, wherein the second and fourth electrical contacts are elastically deflected towards the third wall by a force applied to the respective second and fourth electrical contacts by the electronic circuitry.

27. The electronic device according to claim 21, wherein the first conductive member further comprises a first intermediate portion between the opposite first and second ends and wherein the first intermediate portion is configured to restrain movement of the first conductive member within the connector housing when a force is applied to at least one of the first and second electrical contacts.

28. The electronic device according to claim 21, wherein the second conductive member comprises a second intermediate portion between the opposite third and fourth ends and wherein the second intermediate portion is configured to restrain movement of the second conductive member within the connector housing when a force is applied to at least one of the third and fourth electrical contacts.

29. The electronic device according to claim 21, wherein the electronic module contact interface comprises a plurality of first and second contact portions, wherein the connector housing first wall comprises a plurality of first apertures, wherein the connector housing second wall comprises a plurality of second apertures, wherein the connector housing third wall comprises a plurality of third apertures, and a plurality of pairs of first and second conductive members.

30. The electronic device according to claim 21, wherein the electronic device comprises a wireless communications device.

31. The electronic device according to claim 21, wherein the electronic module comprises a battery module.

* * * * *